US011020789B2

(12) United States Patent
Tripp et al.

(10) Patent No.: US 11,020,789 B2
(45) Date of Patent: Jun. 1, 2021

(54) INTERCHANGEABLE DIE, JOINING TOOL AND JOINING METHOD

(71) Applicant: NEWFREY LLC, New Britain, CT (US)

(72) Inventors: Andreas Tripp, Giessen (DE); Timo Kohlstaedt, Giessen (DE); Joachim Moeser, Giessen (DE)

(73) Assignee: NEWFREY LLC, New Britain, CT (US)

( * ) Notice: Subject to any disclaimer, the term of this patent is extended or adjusted under 35 U.S.C. 154(b) by 527 days.

(21) Appl. No.: 15/185,594

(22) Filed: Jun. 17, 2016

(65) Prior Publication Data

US 2016/0288197 A1 Oct. 6, 2016

Related U.S. Application Data

(63) Continuation of application No. PCT/EP2014/076376, filed on Dec. 3, 2014.

(30) Foreign Application Priority Data

Dec. 18, 2013 (DE) ..... 102013021056.9

(51) Int. Cl.
*B21J 15/36* (2006.01)
*B21J 15/02* (2006.01)

(52) U.S. Cl.
CPC ..... *B21J 15/36* (2013.01); *B21J 15/025* (2013.01)

(58) Field of Classification Search
CPC ... B21J 15/36; B21J 15/025; Y10T 29/49943; Y10T 29/49954; Y10T 29/49956; Y10T 29/49963; B21D 37/04; B23B 31/113; B23B 2240/04; B23Q 3/15506; B23Q 3/15566; B23Q 3/15573
See application file for complete search history.

(56) References Cited

U.S. PATENT DOCUMENTS 1,569,136 A * 1/1926 Pardee, Jr. ..... B21D 28/34 83/687
1,892,739 A * 1/1933 Hugo ..... B23B 31/113 279/93
2,105,391 A * 1/1938 Almdale ..... B21J 15/36 72/482.91
2,773,693 A * 12/1956 Chittenden ..... B23B 31/20 279/48
3,474,710 A * 10/1969 Stryker ..... F15B 15/1438 29/888.06
3,683,667 A * 8/1972 Merriman ..... B44B 5/0057 72/446

(Continued)

FOREIGN PATENT DOCUMENTS

DE 10335085 A1 2/2005
DE 202006013082 U 11/2006

*Primary Examiner* — Edward T Tolan
(74) *Attorney, Agent, or Firm* — Michael P. Leary

(57) ABSTRACT

An interchangeable die for a joining tool includes a die head partially defining a die feature, and a die shank which extends from the die head in an axial direction and is insertable into a shank receptacle of a die receiving portion of a joining tool. A fastening contour is partially defined on the interchangeable die for fastening the interchangeable die on the joining tool. The fastening contour is structured for fastening the interchangeable die on the joining tool by a motion including an insert movement and a rotate movement.

12 Claims, 6 Drawing Sheets

(56) References Cited

U.S. PATENT DOCUMENTS

| | | | | | |
|---|---|---|---|---|---|
| 4,212,559 | A * | 7/1980 | Persson | B23B 31/113 | 299/108 |
| 5,361,473 | A * | 11/1994 | Landes | B21J 15/36 | 227/60 |
| 5,727,302 | A * | 3/1998 | Sawdon | B21D 39/031 | 29/436 |
| 6,785,959 | B2 * | 9/2004 | Sawdon | B21D 39/031 | 29/283.5 |
| 9,629,640 | B2 * | 4/2017 | Stern | A61B 17/162 | |
| 9,796,014 | B2 * | 10/2017 | Weyland | B21J 15/36 | |
| 9,919,356 | B2 * | 3/2018 | Bartig | B21J 15/025 | |
| 2010/0050778 | A1 * | 3/2010 | Herley | G01L 5/246 | 73/761 |
| 2014/0169892 | A1 * | 6/2014 | Hecht | B23C 5/006 | 407/42 |

* cited by examiner

INTERCHANGEABLE DIE, JOINING TOOL AND JOINING METHOD

CROSS-REFERENCE TO RELATED APPLICATIONS

This application is a continuation of international application PCT/EP2014/076376, filed Dec. 3, 2014 which claims priority from German Patent Application No. DE102013021056.9 filed Dec. 18, 2013, the disclosures of which are incorporated herein by reference in their entirety.

The present invention relates to an interchangeable die for a joining tool, said interchangeable die having a die head on which a die feature is realized, and having a die shank which extends from the die head in an axial direction and is insertable into a shank receptacle of a die receiving portion of a joining tool, wherein a fastening contour is realized on the interchangeable die for fastening the interchangeable die on the joining tool.

In addition, the present invention relates to a joining tool having a die receiving portion which comprises a shank receptacle for receiving a die shank of an interchangeable die, in particular of an interchangeable die of the above-designated type, wherein a fastening device for fastening the interchangeable die on the joining tool is realized on the die receiving portion.

Finally, the present invention relates to a method for joining by means of a joining tool which comprises a die receiving portion for an interchangeable die, said method having the steps—move the joining tool to a transfer station in which an interchangeable die is temporarily stored, transfer the interchangeable die into a die receiving portion of the joining tool, wherein a relative axial movement is effected between the die receiving portion and the interchangeable die, and finally carry out a joining process using the interchangeable die.

BACKGROUND OF THE INVENTION

The interchangeable dies in question can be used for clinching or for riveting, in particular for punch riveting. The die feature can be, for example, an axial recess which is realized in the manner of a truncated cone, with or without an elevation in the centre, etc.

The joining tool can be a tool which is suitable for the abovementioned joining process and comprises in particular a C-frame, on the one leg of which the tool, such as for example a punching tool, is arranged, and on the other leg of which the interchangeable die is secured.

A hitherto usual concept for fastening the interchangeable die on the die receptacle consists in providing a transverse bore toward the shank receptacle in the die receiving portion. The interchangeable die can be secured by means of said transverse bore, for example using a grub screw. This type of fastening, however, allows for an automated change of die only at great expense. In addition, the transverse bore is comparatively large such that as regards strength the die receiving portion is weakened.

To avoid the last-mentioned problem, it is known from document DE 20 2006 013 082 U1 to provide a die receiving portion with a bore, fastening means which are supported on the bore wall of the die receiving portion being provided in the bore in order to fasten a tool or a tool holder releasably on the die receiving portion. This can be effected, for example, as a result of a threaded engagement or as a result of a screw which cooperates with a tool holder by means of the bore, but from an end which is opposite the die. For axial securement, the document also describes providing clamping means which can be realized according to the end face wedge principle or are realized using elastomer elements.

Although the problem of having to provide a transverse bore in the die receiving portion for securing the die is avoided in this way, an automatic die change can still only be realized with difficulty.

Interchangeable dies which can be exchanged comparatively simply are known, for example, from document DE 103 35 085 A1. The interchangeable dies shown here comprise a die head and a die shank, a radial groove being realized on the die shank. Quick change receiving means, which can be realized, for example, as latching, tightening or clamping connections, can be provided on a C-frame. In addition, the document discloses a changing station in which tool heads and dies can be held in storage.

BRIEF SUMMARY OF THE EMBODIMENTS

Against said background, it is an object of the invention to provide an improved interchangeable die, an improved joining tool and an improved joining method, wherein an automated die change at a joining tool is possible. The automated change, in this case, is preferably to be realizable on the one hand as quickly as possible. On the other hand, high holding forces, which prevent the interchangeable die being inadvertently pulled out of the die receiving portion after a joining operation, are preferably to be set up nevertheless in the axial direction between the interchangeable die and the die receiving portion.

Said object is achieved in the case of the interchangeable die named in the introduction in that the fastening contour is realized such that an insert/rotate connection can be set up between the interchangeable die and the joining tool.

In the case of the joining tool named in the introduction, the above object is achieved in that the fastening device is realized such that an insert/rotate connection can be set up between the interchangeable die and the joining tool.

Finally, the above object is achieved in the case of the joining method named in the introduction in that when the interchangeable die is transferred as a result of a relative rotation of the interchangeable die and the die receiving portion, an insert/rotate connection is set up between the die receiving portion and the interchangeable die.

An insert/rotate connection is to be understood as a connection which is set up as a result of a relative axial offset between the interchangeable die and the joining tool and a relative rotational offset between the interchangeable die and the joining tool, it being possible to effect said two relative offsets one after another or together at least partially superimposed.

In addition, an insert/rotate connection is to be understood as such a connection where the relative rotation to set up the insert/rotate connection extends over an angle of rotation of <360°, in particular <180°. It is particularly preferred when the angle of rotation to set up the insert/rotate connection is within a range of between 30° and 150°, in particular within a range of between 45° and 135°. In a preferred embodiment, the angle of rotation is precisely 90°.

The insert/rotate connection, in this case, can be effected as a result of directly rotating the interchangeable die relative to the die receiving portion. However, it is also possible that the rotational movement is set up by a further component, for example a closure ring, as is used in some bayonet connections.

Consequently, the insert/rotate connection can be realized as a result of two simple movements, namely a longitudinal movement to insert the die shank into the shank receiving means and a rotational movement at a defined angle of rotation. Such types of movements can be automated in a comparatively simple manner and can be carried out quickly such that automated die changes are easy to realize.

In addition, an insert/rotate connection of this type can be realized such that high holding forces can be set up in the axial direction against the die being pulled out of the die receiving portion. Consequently, the joining tools can also be used "overhead" and the die being removed inadvertently after a joining operation can also be prevented in a reliable manner.

The fastening contour is preferably realized such that at least one axial portion of the fastening contour extends proceeding directly from a shank end face of the die shank. The fastening contour is preferably not rotationally symmetrical. In addition, the fastening contour can be realized in a uniform or continuous manner, but can also consist of several individual contour portions which are not connected to one another.

An interchangeable die is preferably to be understood as a one-piece component where the die head and the die shank are connected together integrally. In general, however, it is also possible to provide the interchangeable die by means of a standard die in connection with a die adapter. In this case, the fastening contour can be realized on a shank of the adapter, and the die can be realized with a simple die shank without a fastening contour which is inserted substantially permanently into a receiving portion of the die adapter, for example by means of a grub screw as in the prior art.

The object is consequently fully achieved.

In the case of the interchangeable die according to the invention, it is particularly preferred when the fastening contour comprises a first circumferential portion with a blocking portion and a second circumferential portion with a release portion, in such a manner that in a first rotational position the die shank is axially insertable into a shank receptacle and/or is axially removable out of the shank receptacle and in a second rotational position it is possible to set up a connection to the joining tool which is positive locking and/or non-positive locking in the axial direction.

Insofar as a positive locking connection can be set up, this is realized in particular such that the positive locking prevents the interchangeable die being inadvertently pulled out of the die receiving portion. In the event of a non-positive locking connection, the non-positive locking is so great that the interchangeable die is also prevented from being inadvertently pulled out of the die receiving portion.

In this case, it is particularly advantageous when in the die shank the release portion comprises an axial recess which extends in the axial direction and/or in the die shank the blocking portion comprises a transverse recess which extends transversely with respect to the axial direction.

The axial recess, in this case, preferably begins directly on the end face of the die shank and extends at least purely in an axial manner in portions in order to enable insertion of a blocking member into the fastening contour in the axial direction. The transverse recess can extend with reference to the axial recess at an angle that is greater than 0° and smaller than 90°.

In one embodiment it is preferred when the transverse recess comprises a helical contour or helix contour around the shank.

The angle of the transverse recess (that is the helical pitch) with reference to the axial direction is, in this case, preferably such that self-locking is not provided. Withdrawal forces can be supported in this connection in part on the helical contour, further means preferably being provided in this case in order to ensure that the interchangeable die does not "unscrew" itself out of the die receiving portion, for example by means of latching means, clamping means or the like.

However, it is especially preferred when the transverse recess with reference to the axial recess comprises such an angle that positive locking is achieved in the axial direction. To this end, the transverse recess can also comprise different helix angles.

In particular, however, it is preferred when the transverse recess extends perpendicular to the axial recess. In this case, an axially positive locking connection can be set up in each case between the interchangeable die and the die receiving portion.

In addition, it is advantageous when the first and the second circumferential portion connect together in the circumferential direction.

As a result, the fastening contour can be produced simply as regards construction and production engineering.

All in all, it is additionally preferred when die latching means are realized on the interchangeable die such that the interchangeable die is securable in a latching manner with reference to the joining tool in a rotational and/or longitudinal position.

As a result, it can be ensured that the positive locking and/or non-positive locking connection between the interchangeable die and the die receiving portion is not inadvertently released.

In this case, it is particularly advantageous when the die latching means are realized on a shank circumferential portion of the die shank and/or on a shank end face of the die shank which is remote from the die head.

The die latching means can be formed by a circumferential radial groove or a radial groove that is defined in the circumferential direction. For example, a groove or indentation into which the latching means of the die receiving portion can engage, however, can also be provided on the shank end face.

According to a further embodiment that is preferred overall, a rotary entrainment contour, with which a rotating device can cooperate for rotating the interchangeable die and which is preferably realized on the die head, is realized on the interchangeable die.

By means of such a rotary entrainment contour it is possible, on the one hand, to rotate the interchangeable die in a targeted manner in order to set up the insert/rotate connection.

In addition, it is possible to hold the interchangeable die in a transfer station in a defined rotational position as a result of the rotary entrainment contour.

A transfer station serves for temporarily storing at least one interchangeable die, wherein the interchangeable die can be taken out of the transfer station by a joining tool to carry out at least one joining operation which uses the interchangeable die and can be stored back in the transfer station again once the joining operation has been carried out. A transfer station of this type preferably comprises a rotating device for rotating the interchangeable die such that when the interchangeable die is removed out of storage an insert/rotate connection can be set up between the interchangeable die and the joining tool.

Such a transfer station together with the joining tool and a plurality of interchangeable dies can form a joining tool system.

In the transfer station it is additionally preferred when the interchangeable die is held there exclusively at its die head, the die shank projecting in relation to an interchangeable die receiving means of the transfer station such that the joining tool can be moved in such a manner that the die shank of an interchangeable die which is held in the transfer station is inserted into the shank receptacle of a die receiving portion of the joining tool.

As a result of the rotary entrainment contour, the interchangeable die, in this case, can preferably be set in rotation (or be held in a rotational position) in order to set up the insert/rotate connection.

According to a further preferred development, the interchangeable die is provided with identification means which are optically detectable, and/or is provided with identification means which can generate a characteristic acoustic signal which is acoustically detectable in the case of a movement of the interchangeable die relative to a die receiving portion.

In general, the identification means can also be formed by RFID means. Finally, it is also conceivable to detect the identity of an interchangeable die just as a result of its die feature which is detected, for example, by means of a camera or the like.

Means to detect the identification means can be arranged on the joining tool and/or in a transfer station. In addition, means to detect the identification means can also be associated just with the joining tool and/or the transfer station such that a joining tool is able to move past said detecting means before a die is stored in the transfer station and/or a die is transferred by a joining tool.

In the case of the joining tool according to the invention, it is particularly preferred when the fastening device of the die receiving portion comprises a blocking member which can cooperate with a blocking portion of a fastening contour of the interchangeable die in order to secure the interchangeable die on the joining tool in a positive locking and/or non positive locking manner in the axial direction.

The blocking member, in this case, can be an element which is rigid with reference to the die receiving portion.

It is particularly preferred when the blocking member projects into a shank receptacle of the die receiving portion.

A development of this type is preferred in particular when a fastening contour is formed on the interchangeable die by an axial recess and/or a transverse recess or a helical recess in the die shank.

It is particularly preferred when a first and/or a second blocking member projects in a chord-like manner into the shank receiving means.

A blocking member of this type can be realized structurally in a simple manner, for example by a pin which passes through a thin transverse bore in the die receiving portion. A pin of this type preferably projects by way of approximately half of its diameter into the shank receiving means.

In all cases it is advantageous when the fastening contour is realized such that the release portion thereof enables axial insertion of the die shank into the shank receiving means in the first rotational position, the blocking member setting up a positive locking and/or non-positive locking connection to the blocking portion of the fastening contour in a second rotational position.

For the case where a fastening contour has a helical blocking portion, it is preferred when the blocking member is provided as a pin which projects into the shank receiving means in the radial direction by way of its longitudinal axis.

In addition, it is altogether advantageous in the case of the joining tool according to the invention when there are provided tool latching means, which are realized for the purpose of interacting with die latching means in order, in a latching manner, to secure an interchangeable die which is received in the die receiving means in a rotational and/or longitudinal position.

The tool latching means, in this case, can comprise in particular a latching element which is prestressed in the latching direction by means of a spring, the latching element engaging in a suitable latching recess of the interchangeable die.

In a preferred manner, the tool latching means are arranged such that they can interact with die latching means which are realized on a shank circumferential portion and/or on a shank end face of the interchangeable die which is remote from the die head, that is such that the tool latching means are arranged in the region of a circumferential region or an axial end region of the shank receiving means.

As a result, the tool latching means can be realized in a simple manner as regards construction and production engineering.

In addition, it is altogether advantageous in the case of the joining tool when the die receiving portion is realized on a die holder which is releasably connectable in a rigid manner to a frame of the joining tool.

In this connection, the die holder is preferably realized as a "dome" which, for example, is connectable to a frame of the joining tool, for example to a leg of a C-frame, by means of a screw-type connection of the like.

As a result of the high forces occurring in the case of said joining operations, not only the interchangeable dies but also the die receiving portion are subject to a certain wear such that the releasable connection to the frame enables simple exchange.

The present invention is in particular realizable without the geometry of the interchangeable die, the die holder or the frame of the joining tool having to be enlarged. Automation of a die change can be achieved in a manner that is easy to realize. In a preferred development, the interchangeable die is connected to the joining tool in a positive locking manner in the axial direction in the connected state.

When two tangentially aligned pins are used as blocking elements in the die receiving portion, an axial recess can be realized on the die shank by radially opposite parallel flattenings which proceed from the end face of the die shank.

A conical form in the region of the bottom shank region can facilitate secure insertion of the die into the die receiving portion.

The transfer of an interchangeable die into a transfer station can be effected such that the die head is inserted into an interchangeable die receiving means of the transfer station in a direction perpendicular to the longitudinal axis of the interchangeable die, positive locking with the rotary entrainment contour on the die head preferably being produced such that a defined rotational position is achieved. The interchangeable die receiving means or a portion thereof is preferably rotatable such that as a result of rotating said component the interchangeable die can be locked in the die receiving portion and/or the rotational offset to release the rotate/insert connection can be carried out. The die can then be pulled perpendicularly out of the die receiving portion by the joining tool being moved away downward. In a corresponding manner, an interchangeable die can be removed out of the transfer station by the joining tool first of all being moved such that the shank portion is inserted in the shank receiving means. The interchangeable die is then rotated such that a positive locking insert/rotate connection is set up. As a result of the rotation, in this connection, the interchangeable die receiving means of the transfer station is preferably opened such that the tool with the received interchangeable die can then be moved out of the transfer station in a direction perpendicular to the longitudinal axis of the interchangeable die.

In the case of an interchangeable die with a helical fastening contour, the interchangeable die can be placed in storage in the transfer station in that said interchangeable die is once again moved into a receiving means such that the head is held in a positive locking manner in the circumferential direction (by means of the rotary entrainment contour). The joining tool can then be moved away downward, as a result of which the interchangeable die is rotated in the interchangeable die receiving means, which at the same time can make sure the interchangeable die is locked in the transfer station.

The sequence is reversed for transferring an interchangeable die out of the transfer station.

In general, the interchangeable dies can have an outer shape which corresponds substantially to standard dies.

It is obvious that the features that have been named above and the features yet to be named below can not only be used in the combination specified in each case, but also in other combinations or standing alone without departing from the framework of the present invention.

BRIEF DESCRIPTION OF THE DRAWINGS

Exemplary embodiments of the invention are shown in the drawing and are explained in more detail in the following description. The drawing is as follows.

DETAILED DESCRIPTION OF THE PREFERRED EMBODIMENTS

Figure 1:
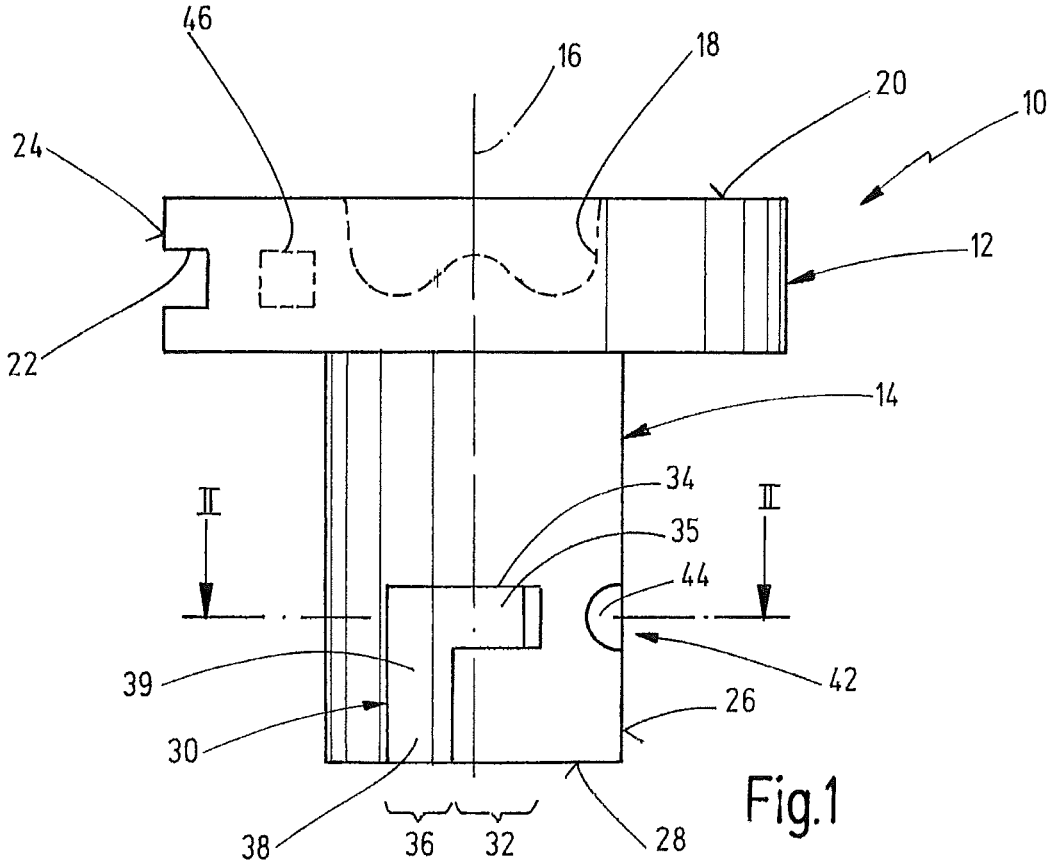
FIG. 1 shows a schematic side view of a first embodiment of an interchangeable die according to the invention.
Figure 2:
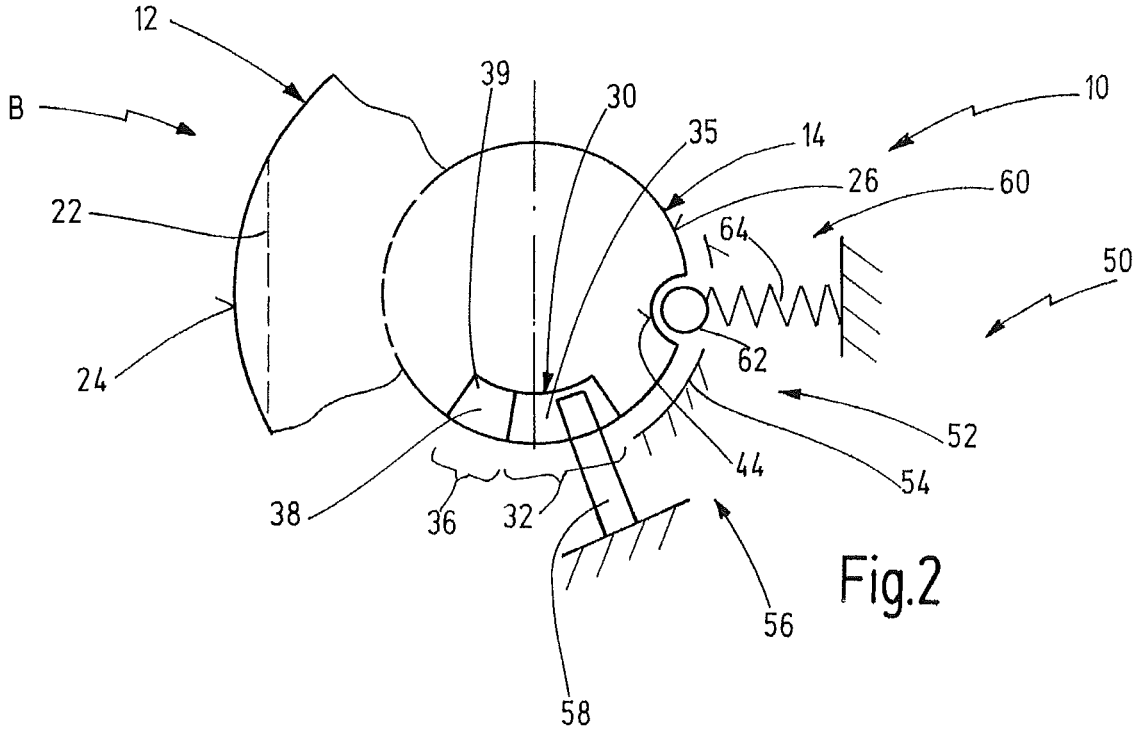
FIG. 2 shows a schematic cross sectional view along the line II-II of FIG. 1, part of the head portion and an embodiment of a joining tool according to the invention additionally being shown.

FIGS. 1 and 2 show a schematic representation from the side of an embodiment of an interchangeable die according to the invention which is given the general reference 10.

The interchangeable die 10 comprises a die head 12 which is preferably circular in cross section, as well as a die shank 14 which is also circular in cross section. The diameter of the die shank 14 is preferably smaller than that of the die head 12. A longitudinal axis 16 is shown.

The die head 12 comprises a head end face 20 which is remote from the die shank 14. A die feature 18 is realized on the head end face 20, for example in the form of an axial recess, as is usual for punch riveting or for other joining processes.

A rotary entrainment contour 22, which can be formed, for example, by one or two radial grooves which extend in a chord-like manner, is realized on a circumferential portion 24 of the head of the die head 12.

A circumferential portion 26 of the shank 14 is shown in FIG. 1. A shank end face 28 is remote from the die head 12.

A fastening contour 30 is realized on the die shank 14. The fastening contour 30 includes a first circumferential portion 32 which comprises a blocking portion 34. The blocking portion 34 can be realized on the die shank 14, for example, by a transverse recess 35 which extends in the direction transversely to the longitudinal axis 16. The fastening contour 30 additionally includes a second circumferential portion 36 which is realized as release portion 38. The release portion 38 preferably includes a longitudinal recess 39 which extends parallel to the longitudinal axis 16. The first circumferential portion 32 and the second circumferential portion 36 connect to one another in the circumferential direction such that a substantially L-shaped contour is produced, as is shown in FIG. 1. The fastening contour 30 extends over a circumferential angle which is preferably smaller than 360° and in particular is smaller than 180°. The circumferential angle preferably lies within a range of between 45° and 135°, in particular within a range of between 70° and 110°.

The interchangeable die 10 additionally comprises die latching means 42 which are preferably realized on the die shank 14. The die latching means 42 can be formed, for example, by a latching recess 44, as is shown in FIGS. 1 and 2.

Identification means 46 are preferably realized on the die head 12.

FIG. 2 shows a schematic sectional view in conjunction with a joining tool 50. The joining tool 50 comprises a die receiving portion 52 which includes a shank receiving means (receptacle) 54. The inside diameter of the shank receiving means 54 corresponds to the outside diameter of the die shank 14. In addition, the joining tool 50 includes a fastening device 56 which, in the present case, comprises a blocking member 58 which extends in the radial direction into the shank receiving means 54. The blocking member 58 can be formed, for example, by a pin or the like which is aligned radially.

The joining tool 50 additionally comprises tool latching means 60 which preferably include a latching element such as a ball 62 and a spring 64.

The tool latching means 60 can interact with the die latching means 42, as is shown in FIG. 2. In this connection, the latching element 62 engages in a latching recess 44.

FIG. 2 shows the interchangeable die 10 in a rotational position B where the blocking member 58 engages in the blocking portion 34.

Prior to this, the interchangeable die 10 has been inserted in the axial direction into the die receiving portion 52 by the die shank 14 having been inserted into the shank receiving means 54 such that the blocking member 58 was aligned in the circumferential direction with the release portion 38. As a result, axial insertion was possible as the release portion 38 extends from the shank end face 28. The interchangeable die 10 was then rotated with reference to the die receiving portion 52 such that the blocking member 58 passed into the blocking portion 34. Consequently an insert/rotate connection is set up. In this connection, in the position shown in FIG. 2 the insert/rotate connection provides a connection which is positive locking in the axial direction between the interchangeable die 10 and the die receiving portion 52.

In said position the tool latching means 60 are additionally in engagement with the die latching means 42 such that said relative rotational position is not inadvertently released (for example as a result of the joining tool 50 making rapid movements).

Figure 3:
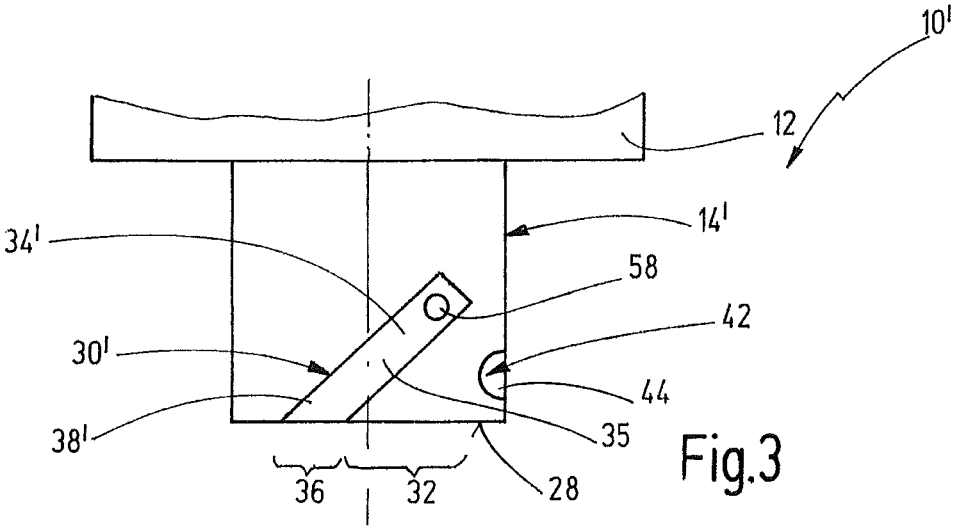
FIG. 3 shows a representation corresponding to FIG. 1 of a further embodiment of an interchangeable die according to the invention.

A further embodiment of an interchangeable die is shown in FIG. 3 and given the general reference 10'. As regards design and method of operation, the interchangeable die 10' corresponds in general to the interchangeable die 10. Identical elements are consequently characterized by identical references. It is essentially the differences that are explained below.

The interchangeable die 10' comprises a die shank 14' with a fastening contour 30' which is realized in a helical manner on the outer circumference 26 of the die shank 14'. The fastening contour 30' extends once again from the shank end face 28 and comprises a narrow second circumferential portion 36 with a release portion 38', to which the helical contour connects by way of the blocking portion 34'. In the rotational position shown in FIG. 3, a blocking member 58 of a die receiving portion 52 is situated in the region of an end of the fastening contour 30'. In said position the interchangeable die 10' is secured axially by combined positive and non-positive locking in relation to forces trying to withdraw it out of the die receiving portion 52. The blocking member 58 can be supported, in this case, on the blocking portion 34' which is realized by the helical groove on the outer circumference 26 of the shank 14'. The pitch of the fastening contour 30' is preferably such that self-locking is not achieved. Accordingly, the rotational position relative to the die receiving portion 52 must be additionally secured by a latching engagement, the latching force preferably being greater than in the case of the embodiment in FIG. 1. The manner of the latching means on the interchangeable die 10' and the die receiving portion 52, however, can otherwise be realized in a substantially identical manner.

As also in the case of the preceding embodiment, a latching recess 44 can also be realized in the region of the shank end face 28.

Figure 4:
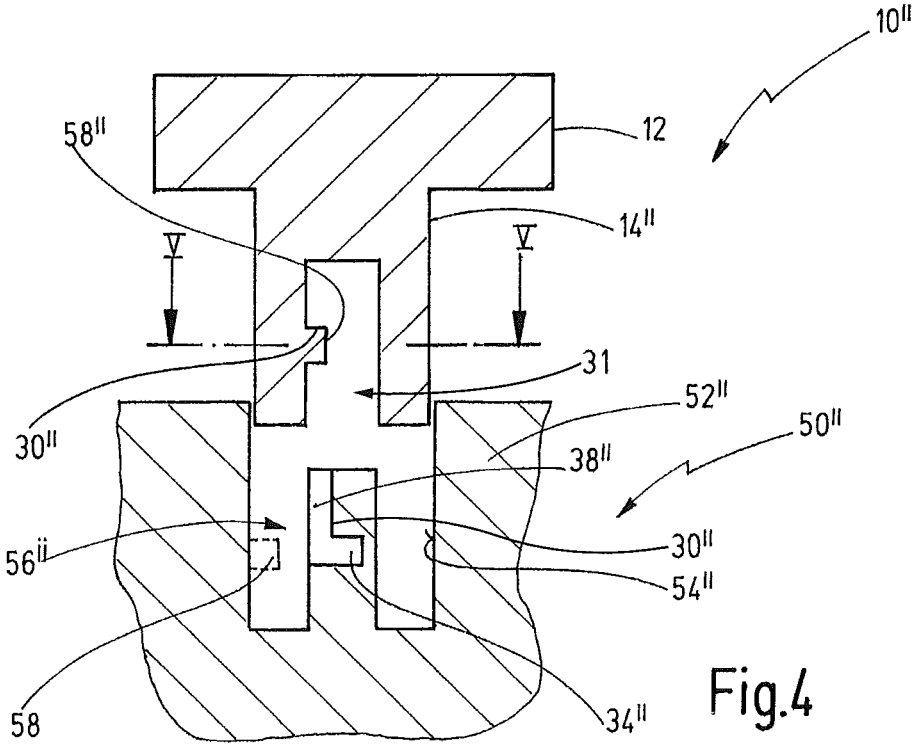
FIG. 4 shows a representation corresponding to FIG. 1 of a further embodiment of an interchangeable die according to the invention and of a further embodiment of a joining tool according to the invention.
Figure 5:
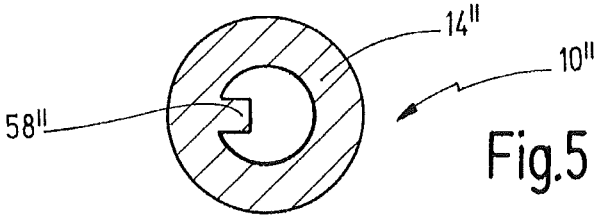
FIG. 5 shows a sectioned view of the interchangeable die along the line V-V of FIG. 4.

FIGS. 4 and 5 show a further embodiment of an interchangeable die 10" which corresponds generally to the interchangeable die 10 of FIGS. 1 and 2 as regards design and method of operation. Identical elements are consequently characterized by identical references. It is essentially the differences that are explained below. The same applies to a joining tool 50" which is shown in FIG. 4.

The interchangeable die 10" comprises a die shank 14" which is realized with a blind hole 31 which proceeds from the shank end face 28. A blocking member 58" in FIG. 4, which forms the fastening contour 30" of the interchangeable die 10", protrudes in the interior of the blind hole 31.

In the case of said embodiment, the joining tool 50 die receiving portion 52" includes a shank receptacle 54" which comprises a fastening device 56" in the form of a journal which projects axially from the bottom and is designed for the purpose of penetrating the blind hole 31 of the die shank 14". A fastening contour 30",34", and 38" in FIG. 5 and which, as regards the design, can correspond to the fastening contour 30 of the interchangeable die 10 in FIG. 1, is realized on the journal 56". In the case of said embodiment, the locations of the blocking member 58 and fastening contour 30 are consequently reversed between the interchangeable die 10" and the die receiving portion 52" compared to the embodiment of FIG. 1.

The reference 58 in FIG. 4 indicates in a schematic manner a blocking member, as would be used in the case of the embodiment in FIG. 1.

Figure 6:
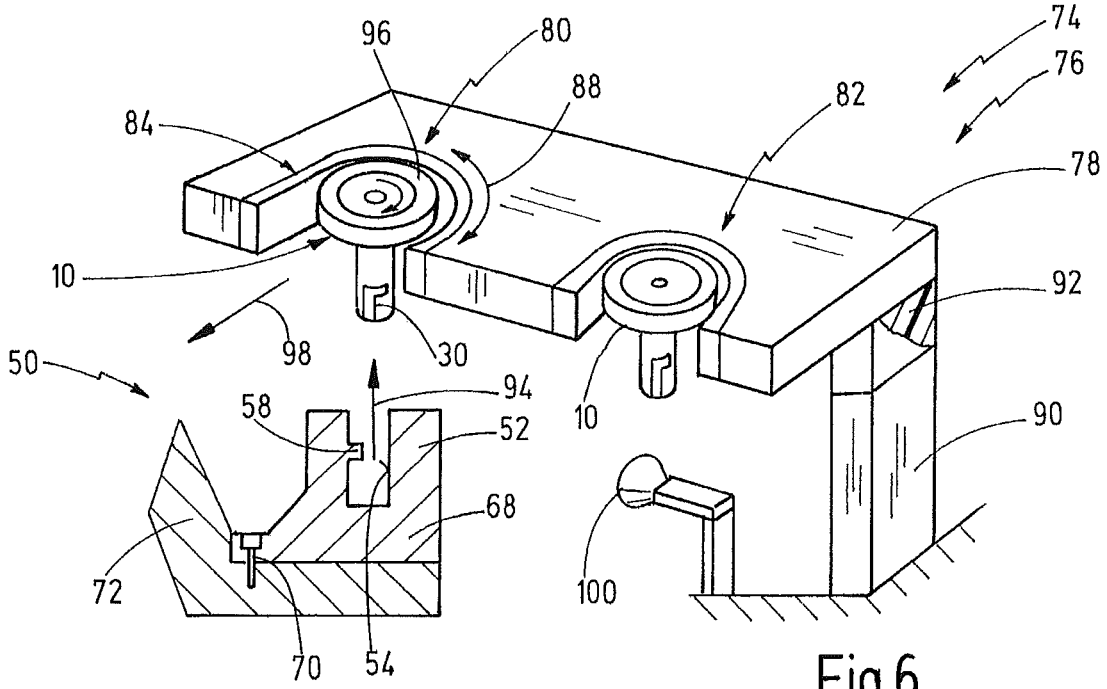
FIG. 6 shows a schematic representation of a joining tool system with a transfer station, in which several interchangeable dies according to the invention are stored temporarily, and with a schematically indicated joining tool according to a further embodiment of the present invention, as well as with identification detecting means.

FIG. 6 shows a portion of a joining tool 50, the joining tool 50 comprising a die holder 68 which is rigidly connected by means of a releasable connection 70 (for example a screw-type connection) to a frame 72 of the joining tool 50, for example a C-frame for punch riveting processes.

The die holder 68 is consequently exchangeable in a simple manner.

The die receiving portion 52, with the shank receiving means 54 and a blocking member 58 which projects into the shank receiving means 54, is realized on the die holder 68.

A joining tool system 74 is formed by the joining tool 50 together with a plurality of interchangeable dies 10 and a transfer station 76.

The transfer station 76 serves for temporarily storing at least one, in particular a plurality of interchangeable dies 10. FIG. 6 shows a schematic representation of a transfer station 76 in which two interchangeable dies 10 can be stored. The transfer station 76 is constructed such that the interchangeable dies 10 are arranged in a linear manner. It is obvious, however, that the interchangeable dies can also be arranged along a circuit.

The transfer station 76 comprises a base 78 which comprises a first interchangeable die receiving means 80 and a second interchangeable die receiving means 82. The interchangeable die receiving means 80, 82 are constructed identically in each case such that just the first interchangeable die receiving means 80 will be described below.

The first interchangeable die receiving means 80 includes a U-shaped portion 84 which is rotatable relative to the base 78.

The U-shaped portion 84 is arranged substantially horizontally. The U-shaped portion 84 is dimensioned such that a respective interchangeable die 10 can be moved into the U-shaped portion 84 in the substantially horizontal position, in particular, however, in a direction transversely with respect to the longitudinal axis of the interchangeable die 10. The U-shaped portion is additionally realized such that it cooperates with the rotary entrainment contour 22 of the interchangeable die 10 in order, in the received state, to hold the interchangeable die 10 in the direction of rotation, in particular in a positive locking manner.

The interchangeable die 10 is held in the interchangeable die receiving means 80 such that the die shank 14 thereof is exposed, that is it is accessible for transfer into the die receiving portion 52.

The U-shaped portion 84 has associated therewith a rotating device 88. The U-shaped portion 84 can be rotated relative to the base 78 by means of the rotating device 88 between the position shown in FIG. 6 where the U-shaped portion is open and a further position where the U-shaped portion 84 has rotated with reference to the base 78 such that the interchangeable die 10 is surrounded in a circumferential manner in part by the U-shaped portion and in part by the base 78. As a result, the interchangeable die 10 can be received in a locked manner in said second position in the transfer station 76.

The U-shaped portion 84 can also be rotated back again by means of the rotating device 88 in order to open the interchangeable die receiving means 80 and to enable the interchangeable die 10 to be removed out of the transfer station 76.

The rotating device 88 can be an active rotating device 88. A rotary drive which rotates the U-shaped portion 84 (and preferably all the U-shaped portion 84 at the same time) can be provided for this purpose. The rotary drive can be, for example, a pneumatic drive, an electric drive or another type of drive.

The rotating device 88, however, can also be a passive rotating device which simply makes rotation possible. In this connection, a drive for rotating the U-shaped portion can be effected, for example, as a result of the tool 50 generating this type of rotational movement in a direct or indirect manner.

The base 78 is mounted on a stationary framework 90 by means of a plurality of elastic elements 92 such that the base 78 is mounted in a floating manner. This makes it possible for the base to carry out compensating movements when placing interchangeable dies into storage and when removing them from storage. This increases the operating reliability and reduces wear and tear.

The transfer of an interchangeable die 10 out of the transfer station 76 into the die receiving portion 52 is effected as follows, the method proceeding from a state where the interchangeable die 10 is locked in the transfer station 76, the U-shaped portion 84 consequently being rotated such that the interchangeable die receiving means 80 is closed.

In a first step, the tool 50 is moved 94 (in particular by means of a robot or the like) such that the die receiving portion 52 is moved toward the die shank 14, as is shown with the reference 94. The rotational position of the tool 50, in this case, is chosen such that the blocking member 58 is aligned with the release portion 38 of the fastening contour 30 in the circumferential direction. Consequently, the die shank 14 is able to be inserted into the shank receiving means 54. As soon as the blocking member 58 is situated at the level of the blocking portion 34 (see FIG. 1), when viewed in the axial direction, the U-shaped portion 84 is rotated 96 by means of the rotating device 88, as is shown with the reference 96.

As a result of the rotational movement, the blocking member 58 is transferred into the blocking portion 34. At the same time, the interchangeable die receiving means 80 is opened such that the U-shaped portion 84 is exposed, as is shown in FIG. 6.

The interchangeable die 10 can then be removed 98 out of the interchangeable die receiving means 80 in a direction transversely with respect to its longitudinal axis, as is shown with the reference 98.

The sequence is reversed for placing an interchangeable die 10 in storage. First of all the interchangeable die is slipped in a translational manner into the open interchangeable die receiving means 80 by means of the tool 50 (in opposition to the direction of the arrow 98). The interchangeable die 10 is then rotated by means of the rotating device 88 (in opposition to the direction 96). As a result, the blocking member 58 is moved out of the blocking portion 34 into the release portion 38 of the fastening contour 30. At the same time, the interchangeable die 10 is locked in the interchangeable die receiving means 80. The tool 50 can then be removed axially from the die shank 14, in opposition to the direction of the arrow 94.

In many cases it is desirable to know and to document which interchangeable die is situated where inside the joining tool system 74. To this end, as mentioned above with reference to FIG. 1, the interchangeable die 10 can comprise an identification means 46.

In a corresponding manner, the joining tool system 74 can comprises an identification means sensor 100 (identification detecting means) which can be associated with the transfer station 76 and/or the tool 50. The ID sensor 100 can be an optical sensor, such as a scanner, a camera or the like. The identification means sensor 100, however, can also be an acoustic sensor (microphone) or an RFID sensor.

The identification means sensor 100 can be arranged next to the transfer station 76, as is shown in FIG. 6. In this case, the tool could be moved past the identification means sensor 100 prior to an operation for placing into storage or to an operation for removing out of storage in order to document the process for placing into storage or the process for removing out of storage.

For increased security, however, it is desirable for each interchangeable die receiving means 80, 82, etc. to have associated therewith its own identification means sensor 100.

For the case where the identification means sensor 100 includes a camera or an optical scanner, it is generally also conceivable not to provide any separate identification means 46 on the interchangeable die 10. Rather, it is conceivable for the respective interchangeable die to be identified as a result of its die feature 18.

Figure 7:
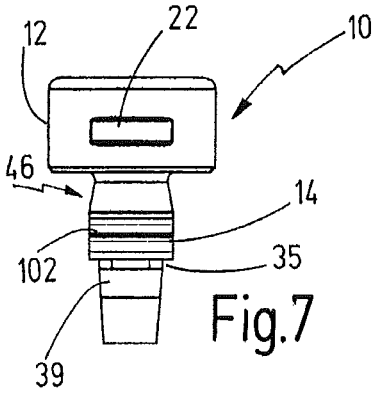
FIG. 7 shows a side view of an embodiment of an interchangeable die according to the invention with a first form of identification means.
Figure 8:
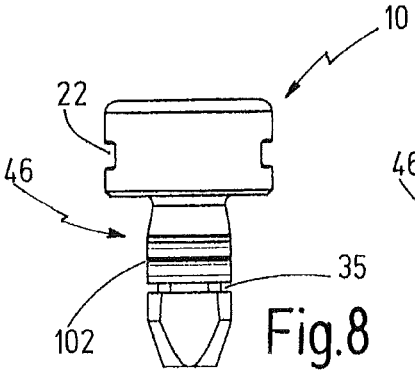
FIG. 8 shows a representation of the interchangeable die of FIG. 7 after a rotation about 90°.

FIGS. 7 to 12 show different types of identification means 46. FIGS. 7 and 8 show an interchangeable die 10 with identification means 46 which are realized in the form of radial grooves 102 on the outer circumference of the die shank 14. The grooves are characteristic of each interchangeable die. Means, which generate a noise when said grooves 102 are traveled over, are preferably provided on the joining tool 50 in this case. Said means can be formed, for example, by the tool latching means 60 or other latching means. The characteristic noise can then be received by an acoustic sensor which evaluates the acoustic signal to identify the interchangeable die 10.

Figure 9:
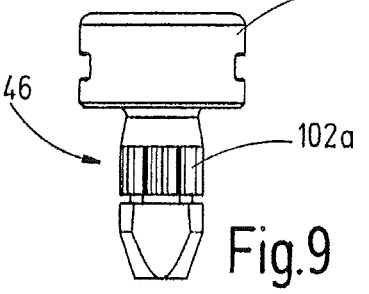
FIG. 9 shows a representation corresponding to FIG. 8 of a further embodiment of an interchangeable die with a further embodiment of identification means.

FIG. 9 provides a view which is comparable to FIG. 8, grooves 102*a* also being used for identification and are provided with the reference 102*a* in FIG. 9. However, the grooves 102*a* in FIG. 9 are realized as longitudinal grooves which provide a characteristic feature for the interchangeable die 10.

Figure 10:
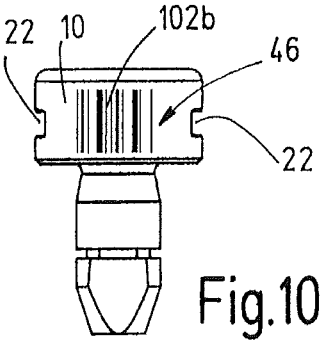
FIG. 10 shows a representation corresponding to FIG. 8 of a further embodiment of an interchangeable die with a further embodiment of identification means.
Figure 11:
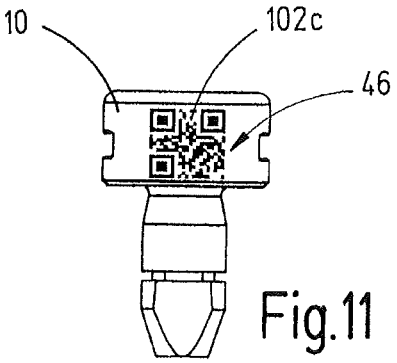
FIG. 11 shows a representation corresponding to FIG. 8 of a further embodiment of an interchangeable die with a further embodiment of identification means.
Figure 12:
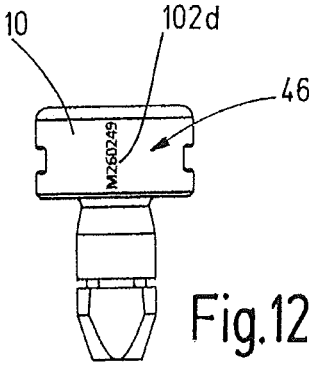
FIG. 12 shows a representation corresponding to FIG. 8 of a further embodiment of an interchangeable die with a further embodiment of identification means.

FIGS. 10 to 12 in each case show optically detectable identification means 46. FIG. 10, in this case, shows a barcode 102*b* which is mounted on the circumferential portion 24 of the head. FIG. 11 shows a 2D code 102*c* which is mounted on the circumferential portion 24 of the head. FIG. 12 shows an alphanumeric code 102*d* which is mounted on the circumferential portion 24 of the head.

When mounting identification means 46 on the circumferential portion 24 of the head, it is preferred when they are arranged between the rotary entrainment contours 22 in the circumferential direction.

FIGS. 13 to 17 show a further embodiment of a joining tool 50 with a die holder 68. An interchangeable die 10 is additionally shown here. Said embodiments generally correspond to the embodiment in FIG. 1 as regards design and method of operation. Identical elements are consequently provided with identical references. It is essentially the differences that are explained below.

The interchangeable die 10 comprises a die shank 14 which includes a circumferential groove with an approximately triangular cross section for forming the transverse recess 35. The release portion 38 is formed by two parallel, diametrically opposite flattenings which form the longitudinal recesses 39 and of which only one is provided in FIG. 13.

A latching recess 44', which is realized as a diametrical recess which is triangular in cross section, is realized on the shank end face 28.

The die receiving portion 52 comprises two thin locking pin bores 106 at an axial height corresponding to the transverse recess 35. The locking pin bores 106 are aligned tangentially with respect to the shank receiving means 54. Two locking pins 108 are inserted into the locking pin bores 106. The spacing between the locking pins 108 (shown by the reference D2 in FIG. 13) corresponds, in this case, to the radial spacing between the longitudinal recesses 39 of the interchangeable die 10. The spacing between the longitudinal axes of the locking pins 108 (shown by the reference D1 in FIG. 13) is preferably identical to the inside diameter of the shank receiving means 54.

Figure 13:
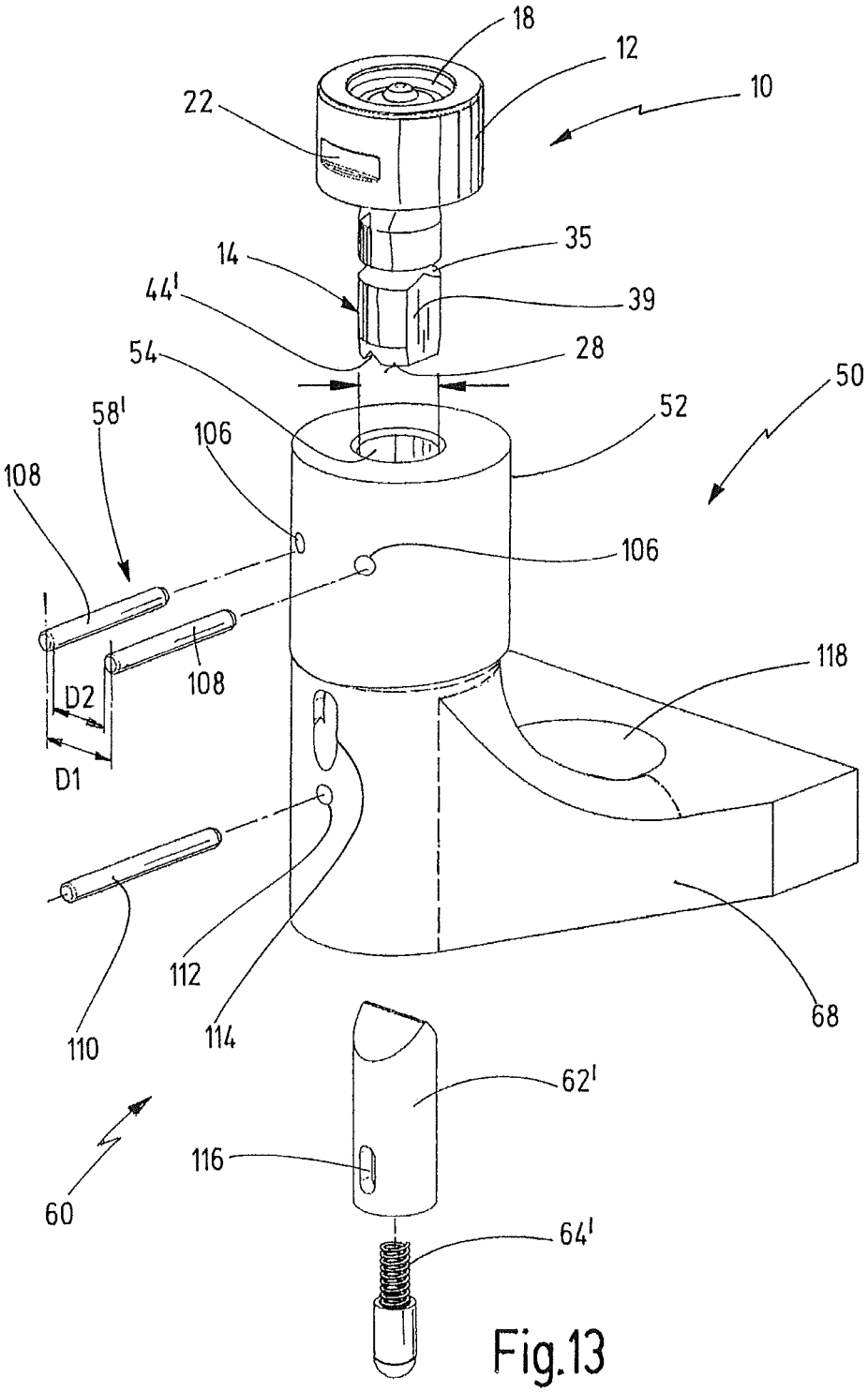
FIG. 13 shows a perspective view of an embodiment of a joining tool with a die holder according to a further embodiment of the invention as well as a perspective view of an interchangeable die according to a further embodiment of the invention.

The dimensions are consequently chosen such that the interchangeable die 10 in the representation shown in FIG. 13 can be inserted into the shank receiving means 54 by way of its die shank 14 as the longitudinal recesses 39 fit precisely between the locking pins 108. As soon as the die head 12 rests on the surface of the die receiving portion 52, the locking pins 108 are situated at the axial height of the transverse recess 35 such that the interchangeable die 10 is able to be rotated inside the shank receiving means 54, in particular about 90°, in order to set up a positive locking insert/rotate connection in this manner.

To realize the tool latching means 60, a latching element is provided in the form of a hollow bushing 62' which tapers at its one end in a wedge-shaped manner such that a latching cog is produced which is able to engage in the latching recess 44'. As is shown in detail in FIGS. 14 and 16, a spring element 64', which is supported in the axial direction on a retaining pin 110, is arranged inside the latching element 62'. The retaining pin 110, in this case, is inserted in the die holder 68 by means of a retaining pin bore 112 and in the latching element 62' by means of longitudinal openings 116.

Figure 14:
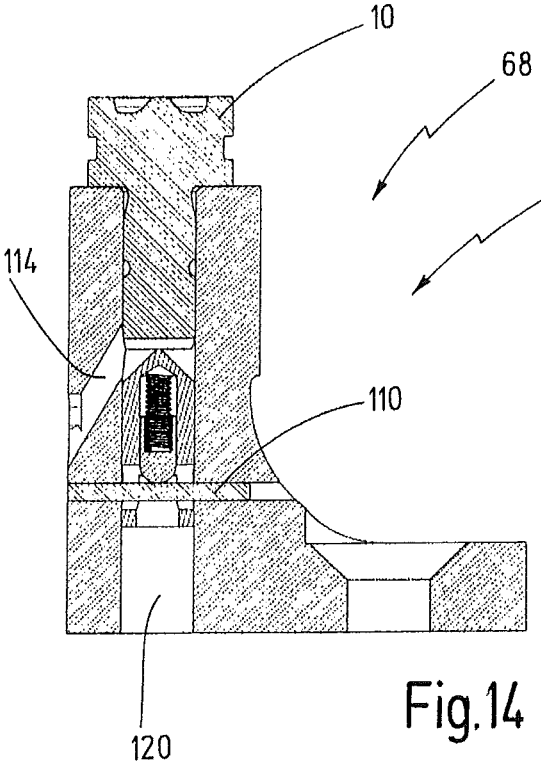
FIG. 14 shows a longitudinal sectioned view of the die holder of the joining tool of FIG. 13, wherein an interchangeable die is inserted into a shank receiving means in a first rotational position.

The mounting of said latching means 60, as can also be seen from FIG. 14, is comparatively simple as the shank receiving means 54 is preferably realized as an axially continuous bore in the die holder 68.

In addition, an ejection opening 114, which extends inclinedly upward in the direction toward the shank receiving means 54 and which is realized in the die holder 68, can be seen in FIGS. 13 and 14. An interchangeable die 10 can be forcibly ejected by means of the ejection opening 114 insofar as said interchangeable die was clamped or the like in the die holder 68.

A fastening bore 118 for the releasable fastening of the die holder 68 on a framework is shown in FIG. 13 with the reference 118, similar to the function as shown in FIG. 6. The continuous longitudinal bore for the shank receiving means 54 is designated with the reference 120 in FIG. 14.

Figure 15:
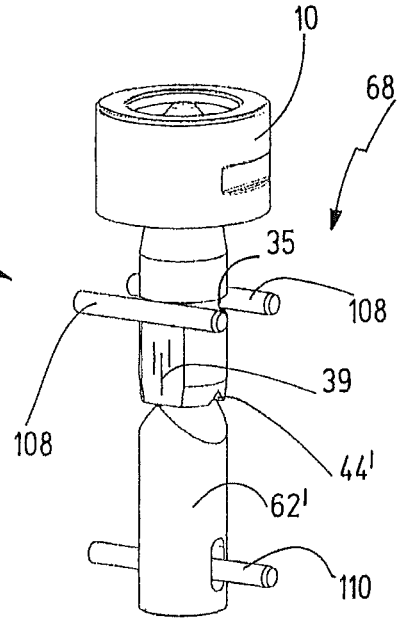
FIG. 15 shows a schematic representation of the interchangeable die and blocking members of the die holder as well as of latching means in the first rotational position.

FIGS. 14 and 15 show a state where the interchangeable die 10 is inserted into the shank receiving means 54, the longitudinal recesses 39 being aligned with the pins 108. In said position, the pins 108 lie at the axial height of the transverse recess 35. In addition, the latching recess 44' is offset in relation to the latching cog of the latching element 62' such that the latching cog does not engage in the latching recess 44'.

Said state corresponds to a relative rotational position between the interchangeable die 10 and the die holder 68, said position being designated in FIG. 15 with the reference A.

Figure 16:
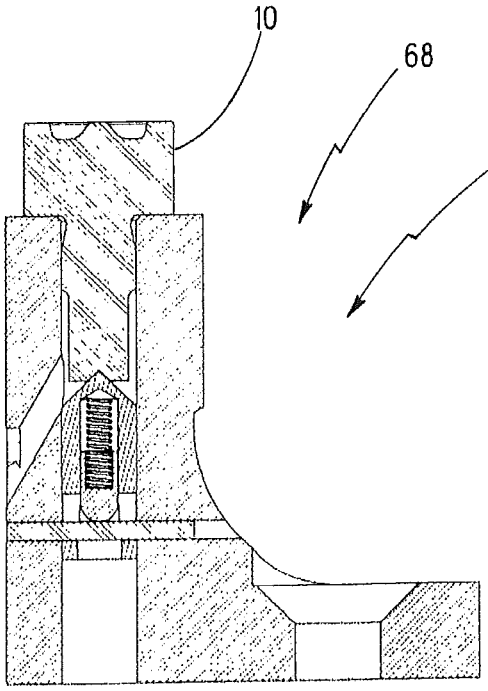
FIG. 16 shows a representation corresponding to FIG. 14 with the interchangeable die in a second rotational position.
Figure 17:
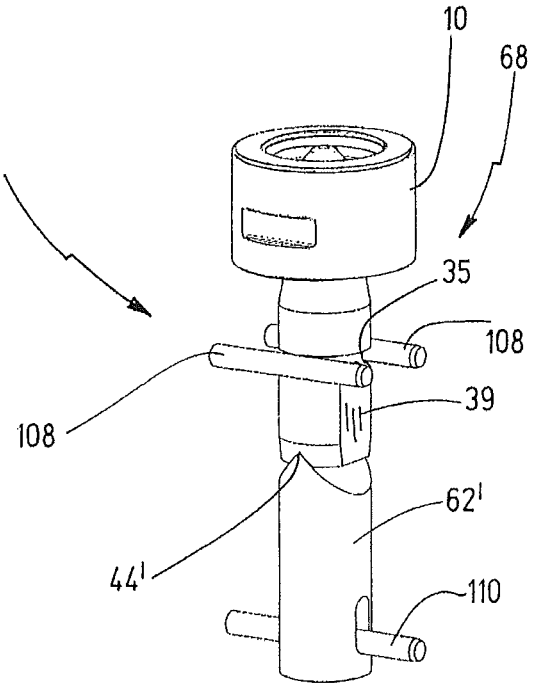
FIG. 17 shows a representation corresponding to FIG. 15 with the interchangeable die in the second rotational position.

FIGS. 16 and 17 show a further rotational position B where the interchangeable die 10 is rotated relative to the die holder 68 about 90°. Accordingly, the pins 108 engage in the transverse recess 35 in a positive locking manner in the axial direction. In addition, the latching cog of the latching element 62' is latched into the latching recess 44'. The latching force is chosen such that unintentional releasing of the rotational position B is able to be avoided. However, rotating by means of the rotating device 88 (see FIG. 6) is possible.

Figure 18:
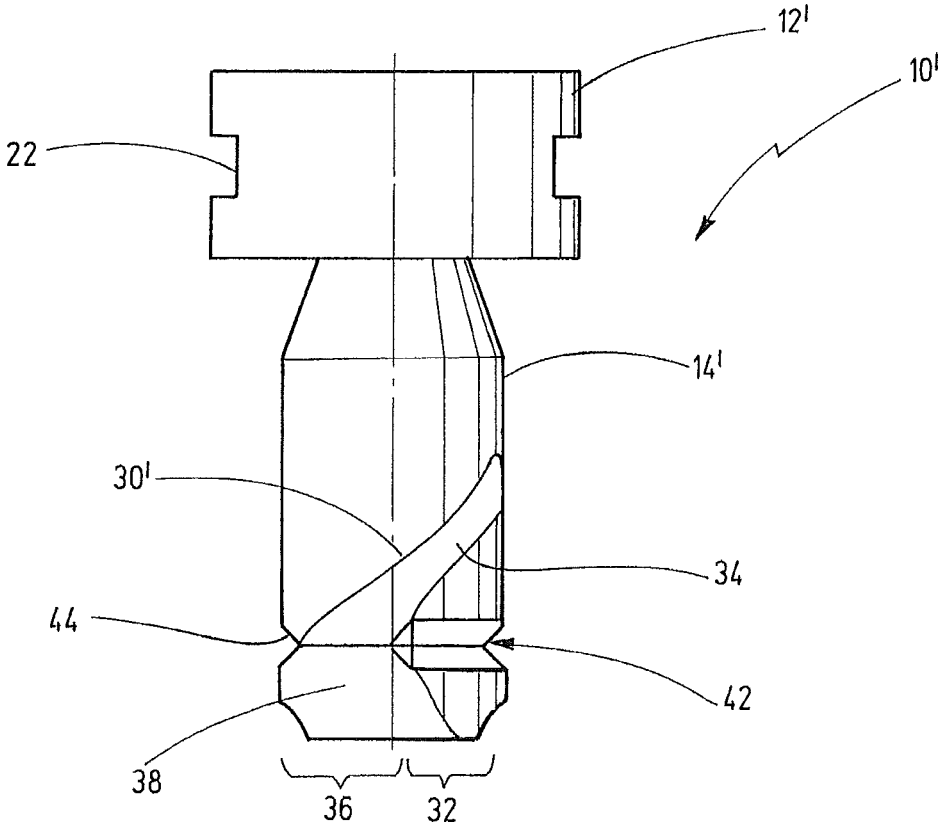
FIG. 18 shows a schematic side view of a further embodiment of an interchangeable die according to the invention which corresponds in general to the interchangeable die of FIG. 3 as regards design and method of operation.

FIG. 18 shows a further embodiment of an interchangeable die 10' which corresponds in general to the interchangeable die 10' of FIG. 3 as regards design and operation. Identical elements are consequently characterized by identical references. It is essentially the differences that are explained below.

The fastening contour 30' of the interchangeable die 10' of FIG. 18 comprises a comparatively wide (when seen in the circumferential direction) second circumferential portion 36 such that a blocking member (like the radially protruding blocking member 58 of FIG. 3) can be easily threaded into the fastening contour 30'.

Additionally shown are die latching means 42 in the form of a latching recess 44 which is circumferential in the circumferential direction and has a substantially triangular cross section.

The interchangeable die 10' enables utilization of a transfer station 76 which does not comprise any active rotary drive for the rotating device 88. When the die receiving portion 52 is moved in the direction of the die shank 14' (corresponding to the movement 94 in FIG. 6), the blocking member 58 consequently threads into the release portion 38 in the region of the second circumferential portion 36 and then generates positive rotation of the interchangeable die 10' inside the transfer station 76 as a result of the helix form of the blocking portion 34.

In the case of a joining tool system 74 which uses the interchangeable die 10', transfer stations 76 which are structurally simpler can consequently be used.

The pitch of the helical recess of the blocking portion 34 is preferably chosen, in this case, such that self-locking cannot occur between the locking portion 34 and the locking member 58.

Pulling the die 10' unintentionally out of the die receiving portion 52 is prevented in the case of said embodiment also preferably as a result of axial movement being restricted by relatively strong latching means which engage in the latching recess 44.

It is obvious that the interchangeable die 10' can also be provided with identification means 46, as is shown as an example in FIGS. 7 to 12.

Although exemplary embodiments of the present invention have been shown and described, it will be appreciated by those skilled in the art that changes may be made to these embodiments without departing from the principles and spirit of the invention, the scope of which is defined in the appended claims and their equivalents.

The invention claimed is:

1. An interchangeable die for installation in a joining tool that includes a die receiving portion with a shank receptacle by use of a rotating device, said interchangeable die comprising:

a die head partially defining a die feature open axially upward thereon;

a die shank which extends from the die head in an axial downward direction and is insertable into the shank receptacle of the die receiving portion of the joining tool;

a fastening contour partially defined in the die shank for fastening the interchangeable die on the joining tool by a motion including an insert movement and a rotate movement;

a rotary entrainment contour partially defined in a circumferential portion of the die head and including a groove extending as a chord across the circumferential portion of the die head; and whereby the rotating device is able to grasp the rotary entrainment contour and rotate the interchangeable die; and a die latching recess located on a shank axial end face remote from the die head and releasably securable to the joining tool in one of a latched rotational and a latched longitudinal position.

2. An interchangeable die according to claim 1, wherein the fastening contour comprises:

a first circumferential portion including a blocking portion;

a second circumferential portion including a release portion; and in a first rotational position the die shank is one of axially insertable into or axially removable out of the shank receptacle; and in a second rotational position there is a connection, which is locked in the axial direction, to the joining tool.

3. An interchangeable die according to claim 2, wherein the release portion of the fastening contour comprises an axial recess partially defined by the die shank, open radially outward, and axial extending; and the blocking portion comprises a transverse recess partially defined by the die shank, open radially outward, and extending transversely with respect to the axial direction.

4. An interchangeable die according to claim 2, wherein the first and the second circumferential portions connect together in the circumferential direction.

5. An interchangeable die according to claim 1, and further comprising an identification device located on one of the die head or the die shank, and the identification device one of:

optically detectable, or able to generate a characteristic acoustic signal which is acoustically detectable in the case of a movement of the interchangeable die relative to a die receiving portion.

6. An interchangeable die for installation in a joining tool that includes a die receiving portion with a shank receptacle by use of a rotating device, said interchangeable die comprising:

a die head partially defining a die feature open axially upward thereon;

a die shank which extends from the die head in an axial downward direction and is insertable into the shank receptacle of the die receiving portion of the joining tool;

a fastening contour partially defined in the die shank for fastening the interchangeable die on the joining tool by a motion including an insert movement and a rotate movement, the fastening contour including a circumferential groove of triangular apex-inward cross section and a pair of diametrically opposed flattenings, extending as parallel chords across the circumference of the shank and extending axially downward from the circumferential groove to a free end of shank distal from the head;

a rotary entrainment contour partially defined in a circumferential portion of the die head and including a groove extending as a chord across the circumferential portion of the die head; and whereby the rotating device is able to grasp the rotary entrainment contour and rotate the interchangeable die; and a die latching recess located on a shank axial end face remote from the die head and releasably securable to the joining tool in one of a latched rotational and a latched longitudinal position.

7. An interchangeable die according to claim 6, and further comprising an identification device located on one of the die head or the die shank.

8. An interchangeable die for installation in a joining tool that includes a die receiving portion with a shank receptacle by use of a rotating device, said interchangeable die comprising:

a die head partially defining a die feature open axially upward thereon;

a die shank which extends from the die head in an axial downward direction and is insertable into the shank receptacle of the die receiving portion of the joining tool;

a fastening contour partially defined in the die shank for fastening the interchangeable die on the joining tool by a motion including an insert movement and a rotate movement;

a rotary entrainment contour partially defined in a circumferential portion of the die head and including a groove extending as a chord across the circumferential portion of the die head; and whereby the rotating device is able to grasp the rotary entrainment contour and rotate the interchangeable die; and a die latching recess located on a shank axial end face remote from the die head and releasably securable to the joining tool in one of a latched rotational and a latched longitudinal position, the latching recess defining a triangular cross section with an apex pointing axially upward toward the head and extending longitudinally diametrically across the shank axial end face.

9. An interchangeable die according to claim 8, wherein the fastening contour comprises:

a first circumferential portion including a blocking portion;

a second circumferential portion including a release portion; and in a first rotational position the die shank is one of axially insertable into or axially removable out of the shank receptacle; and in a second rotational position there is a connection, which is locked in the axial direction, to the joining tool.

10. An interchangeable die according to claim 9, wherein the release portion of the fastening contour comprises an axial recess partially defined by the die shank, open radially outward, and axial extending; and the blocking portion comprises a transverse recess partially defined by the die shank, open radially outward, and extending transversely with respect to the axial direction.

11. An interchangeable die according to claim 9, wherein the first and the second circumferential portions connect together in the circumferential direction.

12. An interchangeable die according to claim 9, and further comprising an identification device located on one of the die head or the die shank.

* * * * *